US007810167B2

(12) United States Patent
Seitzinger et al.

(10) Patent No.: US 7,810,167 B2
(45) **Date of Patent: *Oct. 12, 2010**

(54) TACTICAL BALLISTIC LOWER BODY ARMOR OUTERWEAR

(75) Inventors: Kyle Seitzinger, 2104 Castle Beach Ct., League City, TX (US) 77573; Jack Seitzinger, Kemah, TX (US)

(73) Assignee: Kyle Seitzinger, The Woodlands, TX (US)

( * ) Notice: Subject to any disclaimer, the term of this patent is extended or adjusted under 35 U.S.C. 154(b) by 267 days.

This patent is subject to a terminal disclaimer.

(21) Appl. No.: 11/180,326

(22) Filed: Jul. 13, 2005

(65) Prior Publication Data

US 2007/0016996 A1 Jan. 25, 2007

Related U.S. Application Data

(60) Provisional application No. 60/613,368, filed on Sep. 27, 2004.

(51) Int. Cl.
*A41D 13/00* (2006.01)

(52) U.S. Cl. ..... 2/2.5; 2/238

(58) Field of Classification Search ..... 2/2.5, 2/94, 102, 79, 227, 69, 465, 466, 228; 89/36.05
See application file for complete search history.

(56) References Cited

U.S. PATENT DOCUMENTS

| | | | | |
|---|---|---|---|---|
| 5,495,621 | A * | 3/1996 | Kibbee | 2/2.5 |
| 5,754,982 | A * | 5/1998 | Gainer | 2/2.5 |
| 5,966,747 | A * | 10/1999 | Crupi et al. | 2/466 |
| 6,453,791 | B1 * | 9/2002 | Seitzinger | 89/36.05 |
| 6,804,832 | B2 * | 10/2004 | Beland | 2/227 |
| 6,961,958 | B1 * | 11/2005 | Seitzinger | 2/2.5 |

* cited by examiner

*Primary Examiner*—Tejash Patel
(74) *Attorney, Agent, or Firm*—Buskop Law Group, PC; Wendy Buskop

(57) ABSTRACT

An over garment body armor in the form of shorts or long pants that are wearable over conventional clothing. The over garment body has two or more front leg pockets and at least one back pocket. The front leg pockets cover the femoral artery paths on the leg and the back pocket covers the lower portion of the spine. Ballistic protection pads are inserted into the pockets to protect the wear from bullets and projectiles.

18 Claims, 9 Drawing Sheets

TACTICAL BALLISTIC LOWER BODY ARMOR OUTERWEAR

CROSS REFERENCE TO RELATED APPLICATIONS

The present application claims priority to Provisional U.S. Patent Application Ser. No. 60/613,368, filed on Sep. 27, 2004.

FIELD

The present embodiments relate generally to tactical ballistic lower body, bullet and projectile resistant, outerwear that can be put on quickly and can be worn easily over conventional clothing.

BACKGROUND

Gun shot wounds and fragmentation from explosive devices (IED) to the femur artery of the human body cause death in most cases. Body armor has existed for many years, but body armor for wearing over clothing to protect the lower portion of the body has not been developed.

Often law enforcement officers that conduct raids are required to leave their desk at a moments notice by their superior to go perform a raid. These law enforcement officers normally do not wear bullet proof garments when at their desks performing other tasks. These officers must be able to put on quickly bullet proof garments in order to protect themselves when conducting the raid. Further, military personnel during their normal tour of duty in hostile areas can choose to wear outer garment ballistic protection for the lower body. Thousands of soldiers have been wounded, killed, or lost lower limbs in battlefields because of hits to their unprotected lower body.

Vascular injuries to the lower abdomen and lower extremities carry a high mortality rate. In a study at Ben Tub Hospital of Houston, Tex. of 600 patients with penetrating trauma to the iliac vessels and femoral arteries, 39% of the patients died within 30 days of injury. In certain cases of penetrating trauma to the iliac vessels, cardiac arrest occurred within six minutes to eight minutes of impact.

A need exists for an over clothes body armor that provides protection over the femur artery, the femoral artery path, and the lower spine. The over clothes body armor should be light and flexible so that a user will wear the device. A need exists for the over clothes body armor to be adaptable to add ceramic plates or similar hard ballistic materials placed in external pockets to provide even higher levels of protection—NIJ Level IV. Additional pockets and straps should be easily added to the carrier to enable the wearer to attach equipment to the shorts for ready access: this may include Velcro straps for flashlights, canteens, ammunition pouches, etc.

The present embodiments meet these needs.

BRIEF DESCRIPTION OF THE DRAWINGS

The detailed description will be better understood in conjunction with the accompanying drawings as follows.

Figure 1:
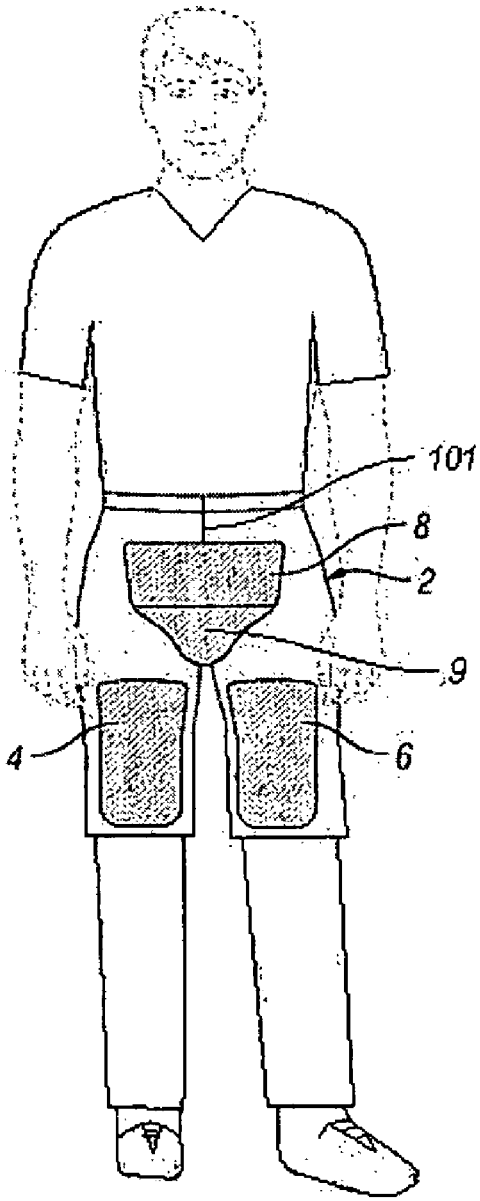
FIG. 1 depicts a front perspective view of a pair of over garment shorts.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments, and that it can be practiced or carried out in various ways.

The present embodiments are wearable body armor in the form of outerwear pants and shorts. The over garment body armor can be put on quickly and is designed to be worn over conventional clothing. The present embodiments are important for law enforcement officers and soldiers who need protection for the lower body, especially the femoral artery paths in the legs since damage to the femoral artery paths often results in death.

The present embodiments provide protection to the thighs, lower abdomen and hamstring area of the leg. The body armor of the present embodiments provides the simultaneous protection of the spine which prevents paralysis of the wearer by a bullet or projectile fragment and the femoral artery to prevent the death of the wearer. The over garment shorts or pants can be made of a sturdy, breathable and flexible material with a various levels of ballistic protection levels provided by inserts in the carrier.

For example, the present embodiments can be helpful for law enforcement officers that often conduct raids. The raids are often very dangerous and often entail arresting or subduing armed suspects. The officers put their lives in danger to arrest these suspects. The present embodiments are designed to lower the risks faced by these law enforcement officers. An officer who conducts raids normally is not wearing the armor protection throughout the day, since the armor is typically heavy and uncomfortable to wear. Once the law enforcement officers are needed on a raid, the officers need to be able to put on protective garments quickly. Currently, law enforcement officers utilize body armor jackets that do not protect anything below the waist. The present embodiments provide a quick pull-on over garment body armor that protects the critical areas of the femoral arteries in the leg and the lower portion of the spine.

Additionally, military personnel in hostile zones need lower body armor external garments for protection from conventional weapons and explosive devices. With armored plates placed in the garments external pockets, the soldiers can receive the maximum level of protection possible (Level IV) in the protected areas. External armored plates can be placed in a number of configurations to meet the specific needs of the wearer. A soldier or officer's assignment may dictate a different configuration. For example, a soldier on patrol in a war zone may require body armor with a configuration stressing mobility and IED protection. In contrast, a helicopter pilot may require wear with a configuration that stresses protection for the back of the legs and the posterior area. Even further, law enforcement officers may require optional external pocket protection for maximum protection in dangerous situations.

The spinal and femoral artery protection saves lives. Currently when an officer or soldier is shot in the femoral artery, the officer will only survive four minutes to six minutes without medical treatment. Unfortunately, even if the medical treatment personnel could reach the wearer in time, the wearer is often forced to stay at a distance in a shooting situation until the area is secured.

With reference to the figures, FIG. 1 depicts a front view of the over garment body armor having over garment shorts 2 with two leg pockets 4 and 6. More than two leg pockets can be used, as long as the leg pockets cover the femoral artery paths of each leg. FIG. 1 further depicts a front pocket 8 covering the lower portion of the abdomen. A second front pocket 9 can cover the genital area of the body. Each pocket includes one or more ballistic protection pads. The pockets into which the ballistic protection pads are placed are sewn in such a manner as to exactly conform to the shape of the ballistic protection pads.

The over garment pants and shorts are made of a durable, wearable material that is easily pulled over other clothing. In one embodiment, the over garment body armor are shorts or pants made of a durable, wearable material, such as nylon, cotton, a blend of nylon and cotton, other microfiber materials, or combinations. The over garment body armor is lightweight and flexible.

The garment can be easily pulled over issued uniform pants, dress slacks, jeans, or any other pants. The size of the over garment pants are large enough that the over garment pant can be easily pulled over a variety of clothing items that are worn below the waist.

Figure 2:
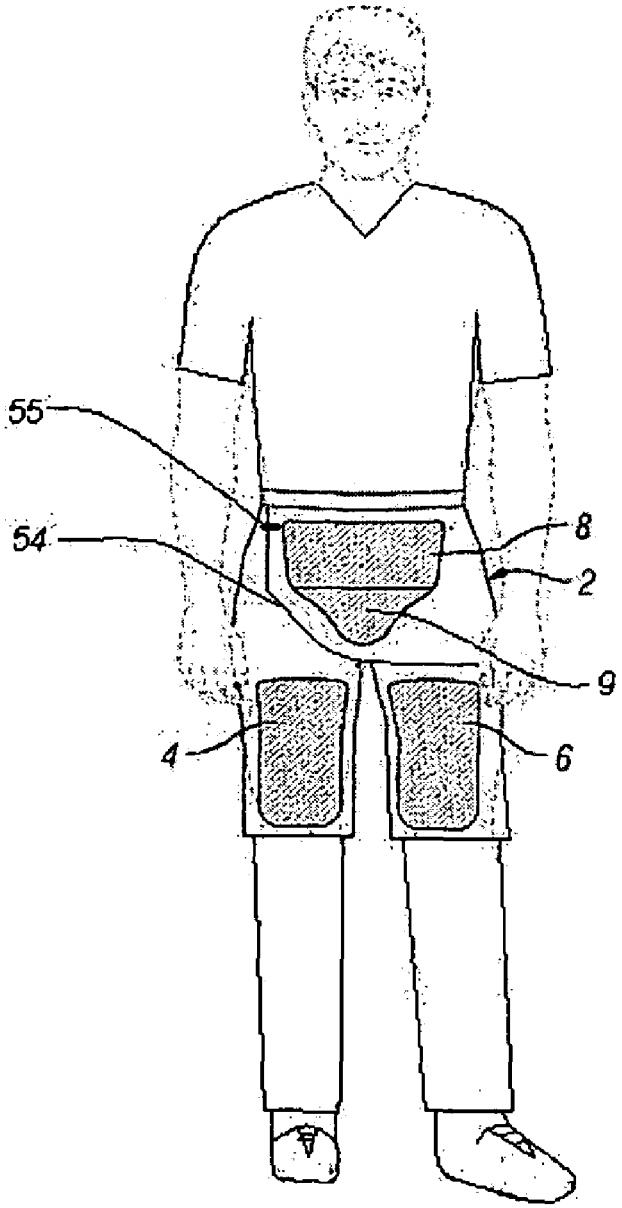
FIG. 2 depicts a front perspective view of a pair of over garment shorts with a flap for quick entry.

FIG. 2 depicts over garment body armor shown in FIG. 1 with the added feature of a flap 54. The flap 54 contains a removable body armor plate that can be attached at the hip on one side of the over garment short of the wearer and can be pulled across the waist of the wearer. The flap 54 is fastened to the other over garment hip. The flap 54 can cover the entire lower abdomen and genital area. The flap 54 is similar to bunker gear that fire fighters wear.

The over garment body armor 2 can be secured over the outer street clothing using a fastener 55 which closes the shorts in a conventional manner. In an alternative embodiment, the over garment shorts 2 can have an elastic waist or buttons. In FIG. 1, the over garment shorts are fastened with a zipper 101, but other fasteners can be used.

Figure 3:
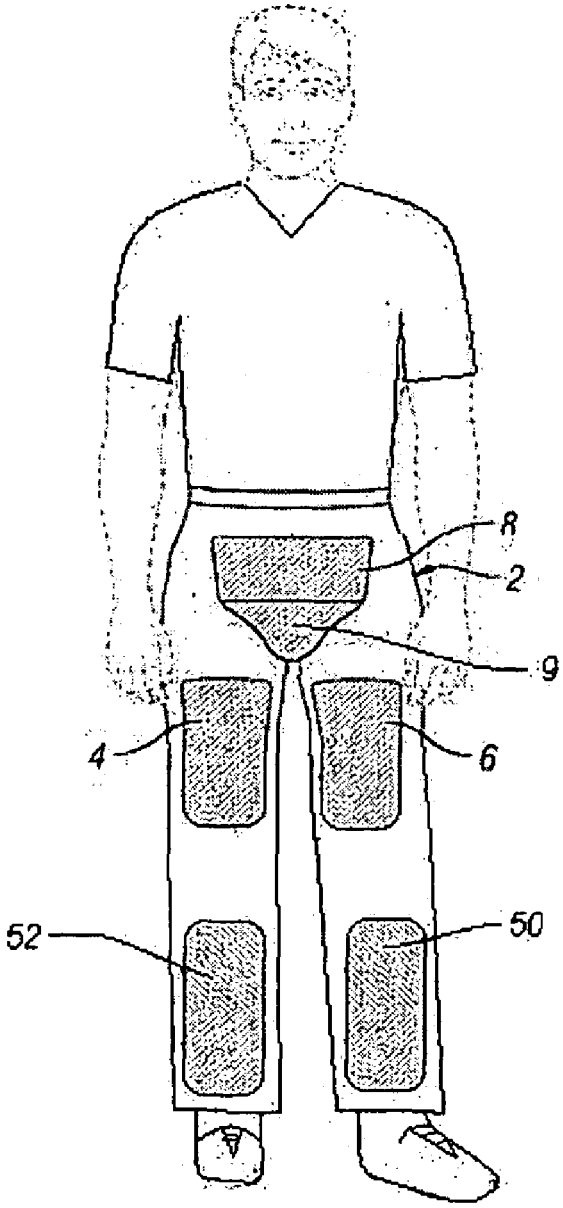
FIG. 3 depicts a front perspective view of a pair of over garment long pants with ballistic protection.

FIG. 3 depicts an over garment body armor 2 as long pants. The over garment pants 2 shown has four leg pockets 4, 6, 50, and 52 and front pockets 8 and 9. The four leg pockets 4, 6, 50, and 52 cover the femoral artery paths in each leg. The front pockets 8 and 9 cover the lower portion of the abdomen and a genital area. Again, even though only four leg pockets 4, 6, 50, and 52 are depicted in FIG. 3, more leg pockets can be added. More numerous and smaller pockets can be used. The pockets are designed to fit the size and shape of the ballistic pads. The number of pockets is dependent upon the size and shape of the ballistic pads, the length of the over garment's leg, and the necessity to cover the femoral artery paths in each leg. The over garment pants can extend from the bottom of the leg pockets to the ankle and the back lower leg pockets can extend from the back leg pockets to the ankle.

Figure 4:
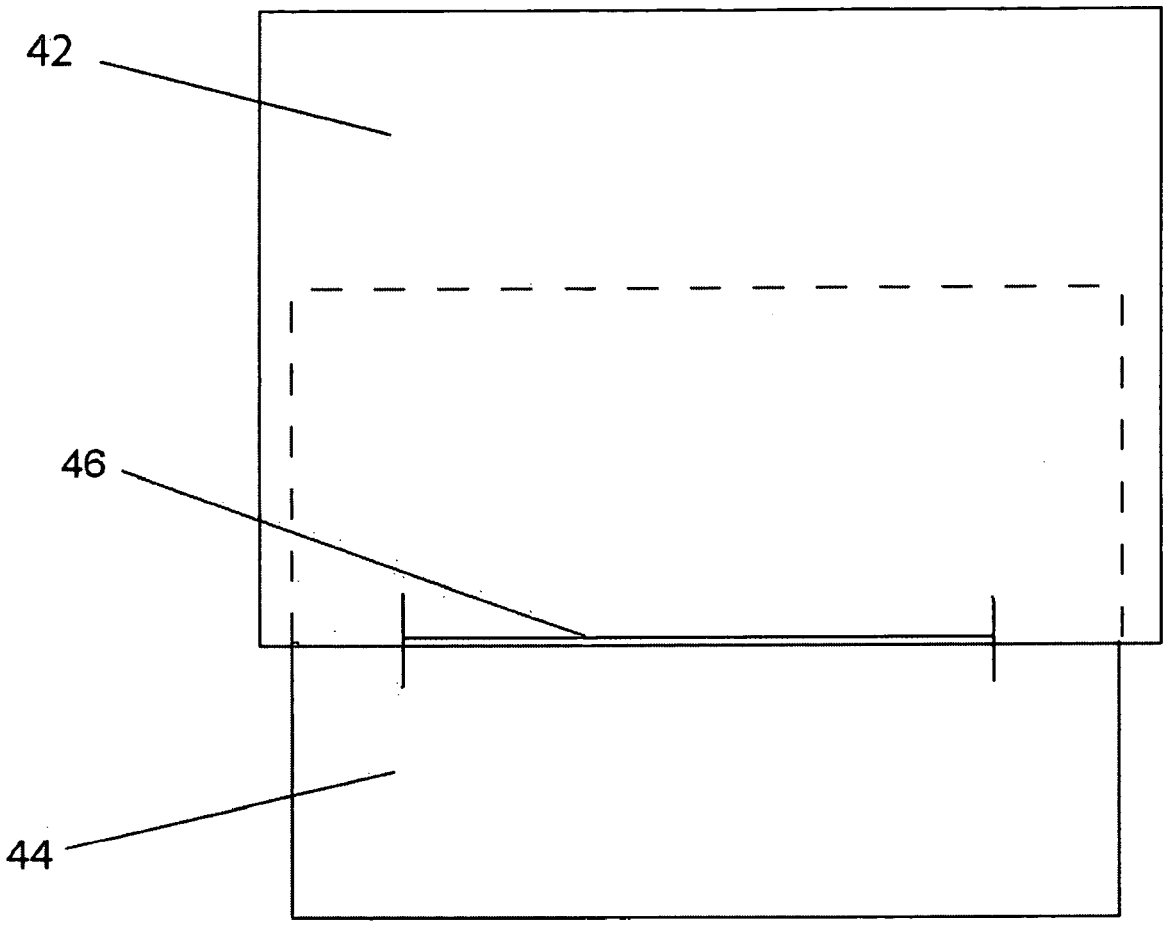
FIG. 4 depicts an embodiment of a closeable pocket usable with the over garment pants.

The pockets can all be closeable pockets in order to allow the ballistic pads to be removed. FIG. 4 depicts an example pocket made from two pieces of overlapping material. The first piece of material 44 is beneath the second piece of material 42 forming an opening 46. The opening 46 is not attached to the pant in order to allow the ballistic pad to be inserted into the opening 46 and reside behind the first piece of material 44. The ballistic pad is held in the pocket by the second piece of material 42.

Figure 5:
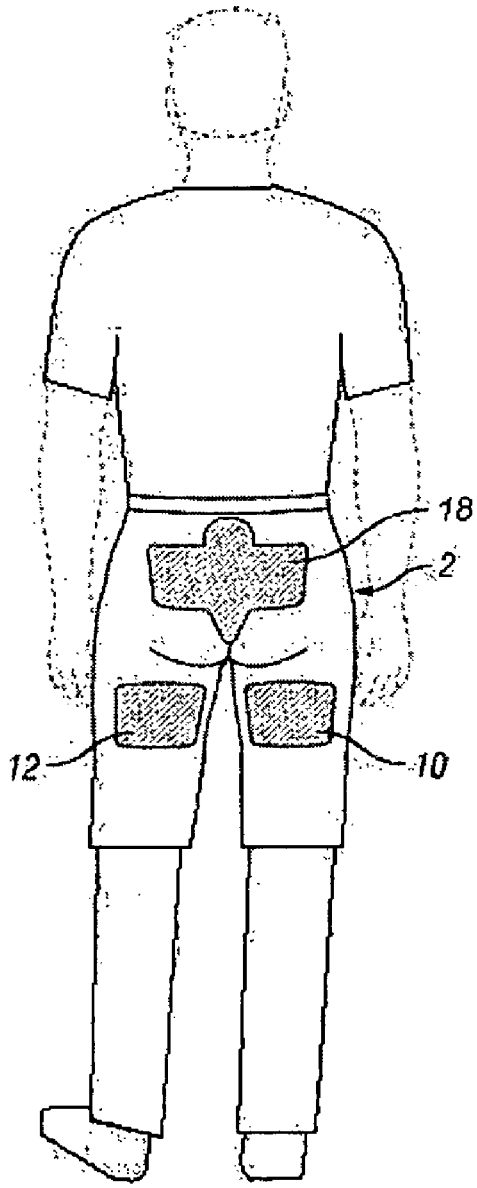
FIG. 5 depicts a rear perspective view of a pair of over garment shorts with a T-shape protection pocket.
Figure 6:
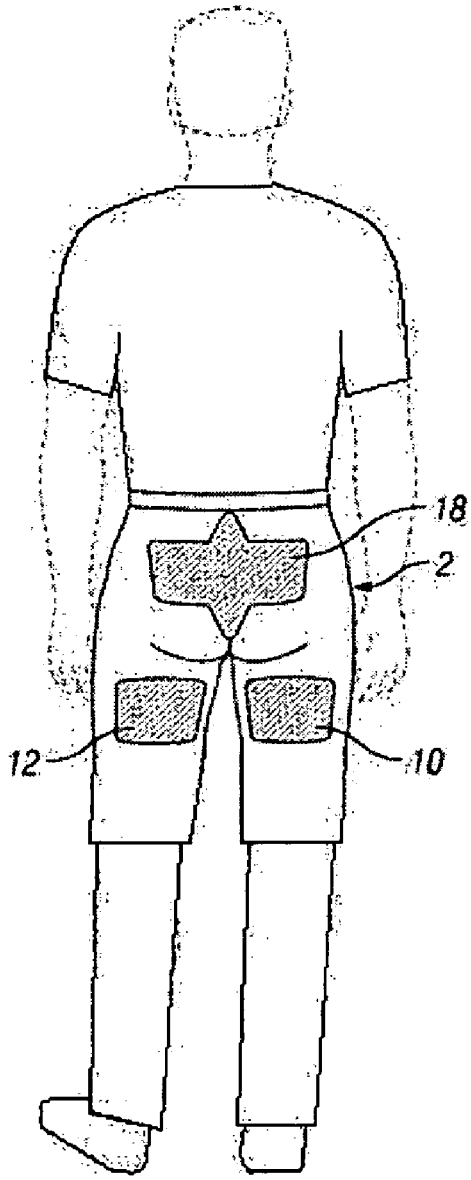
FIG. 6 depicts a rear perspective view of a pair of over garment shorts with a cross-shape protection pocket.

FIG. 5 and FIG. 6 depict in back views of an embodiment of the over garment body armor 2 as shorts. The over garment body armor 2 can have two or more back leg pockets 10 and 12 to protect the hamstring of the wearer. The back leg pockets 10 and 12 also protect the femoral artery paths in each leg from ballistics shot through the back of leg. The over garment body armor 2 can have one or more back pockets 18 covering the lower portion of the spine of the wearer.

The embodiment in FIG. 5 and FIG. 6 depicts alternative example embodiments of the back pocket 18 and associated back pocket ballistics pad. The ballistic pad in the back pocket 18 provides spinal protection while additionally protecting the nerves of the spinal cord. The back pocket 18 and associated back pocket ballistics pad used as a spinal protector can have a rectangle, an elliptical shape, a cross shape, or a T-shape. The cross shape protects more of the spinal cord by extending higher on the back and providing protection to the point where upper body protection extends downward. The solid, multilayered ballistic protection pad can have a height from head to toe less than the width, thereby providing unique spinal protection.

Figure 7:
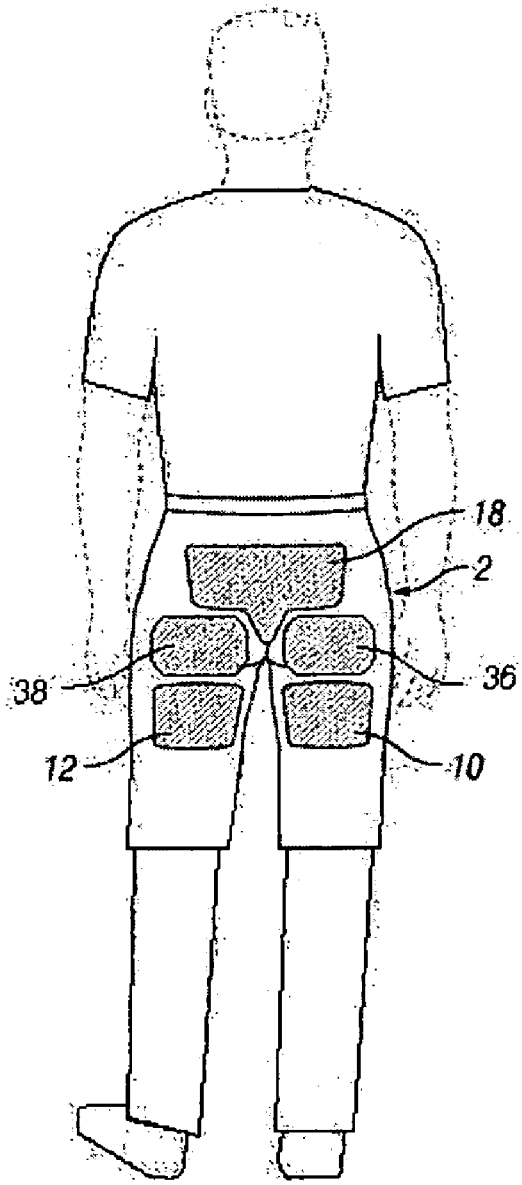
FIG. 7 depicts a rear perspective view of a pair of over garment shorts with buttock protection pockets.
Figure 8:
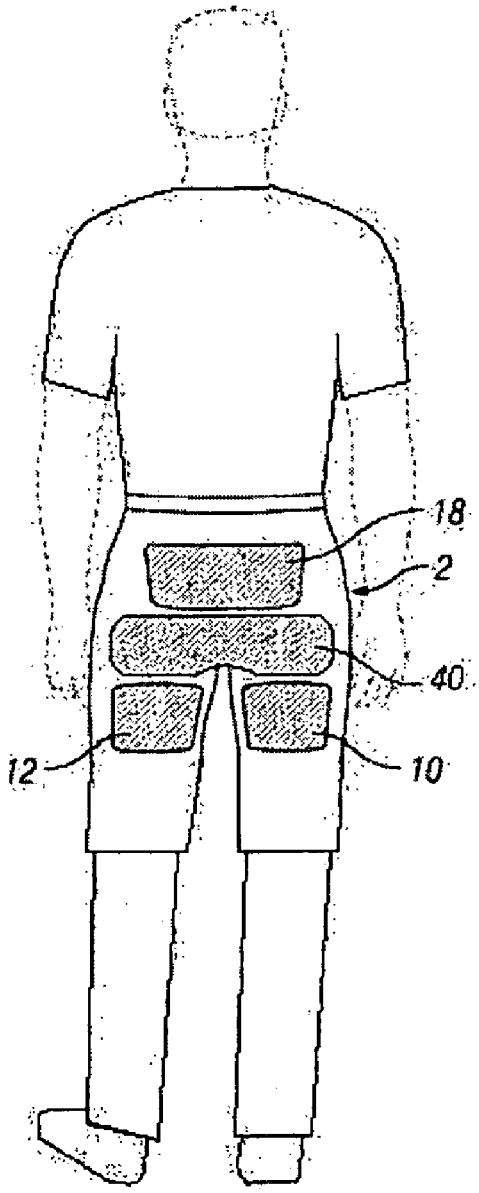
FIG. 8 depicts a rear perspective view of a pair of over garment shorts with one buttock protection pad.

FIG. 7 depicts two additional pockets not shown in FIG. 5 or FIG. 6 covering the buttocks. The buttocks pockets 36 and 38 can be located between the back pocket 18 and the back leg pockets 10 and 12. FIG. 8 depicts another embodiment wherein only one pocket covers the buttocks. The larger buttock pocket 40 can be located between the back pocket 18 and the back leg pockets 10 and 12. FIG. 7 and FIG. 8 example that multiple configuration of pockets and pads are possible for both the pant and shorts embodiments.

One or more ballistic protection pads are inserted into each of the pockets. The ballistic protection pads protect the femoral artery path, the lower portion of the abdomen, and other critical areas covers by the pockets. The ballistic protection pads are removable in order to allow the over garment to be washed. The pockets can all be closeable pockets. If the ballistic protection pad or packet is placed into a pocket, the pocket can be closable. If the pocket is closable, the pocket can be secured with a fastener, such as hook and loop fasteners, zippers, snaps, and buttons. An example of a hook and loop fastener is Velcro®.

Figure 9:
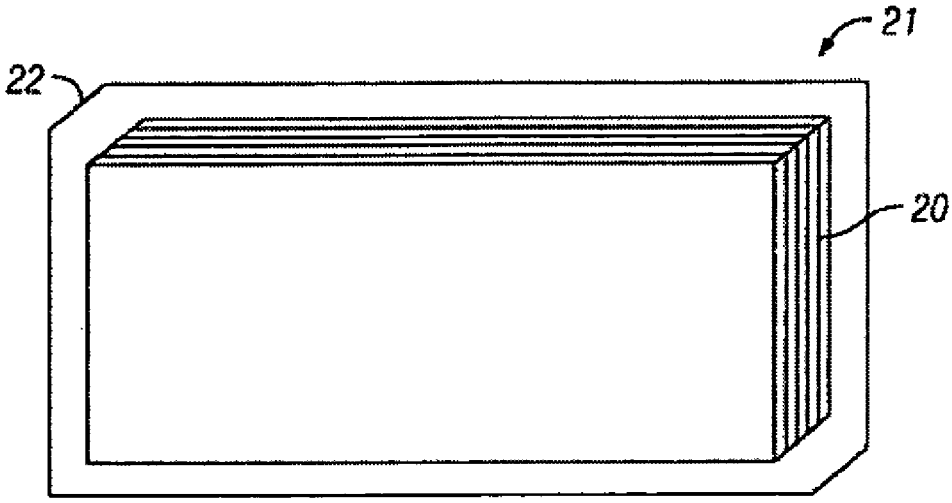
FIG. 9 depicts a cross sectional view of the ballistic protection packet usable in the pockets of the over garment shorts.

FIG. 9 depicts a cross sectional view of ballistic protection pads 21 located in a pocket. The ballistic protection pads 21 can be configured in a packet, wherein the packet includes a number of ballistic protection pads. The packet can be a nylon, water resistant, tear resistant, covering that encloses the ballistic protection pads. An example material is "SPECTRAFLEX" available from Allied Signal Company. The packet allows the user to remove and insert the ballistic protection pads easily. The ballistic material can be a material such as.

The National Institute of Justice grades the levels of body armor. The ballistic protection pads can be one of the classification types of the National Institutes of Justice consisting of Type I, Type IIa, Type II, Type IIIa, Type III, and Type IV. Preferably, graded levels II and IIIa utilizing eighteen layers of ballistic material can be used. Grade II uses fifteen layers of ballistic material and is capable of stopping a bullet fired by a 357 Magnum at a velocity of 1,395 feet per second. The same grade level stops a 9-mm bullet fired at a velocity of 1,175 feet per second. The embodied body armors can be used with a Grade IIa ballistic protection having thirteen layers and can stop a 9-mm bullet traveling at a velocity of 1,090 feet per second. The level III protection stops a 7.63 NATO round of bullets traveling at a velocity of 2,750 feet per second. Level IV can only be attained by adding hard armor plates to the garment.

The minimum pad insertable in the pockets is a Type I National Institute of Justice Ballistic Protection pad. A removable ballistic protection pad classified as Type II by the National Institute of Justice should be used in each pocket that covers the femoral artery paths and the lower portion of the abdomen.

These multi-layer ballistic protection pads can be of a variety of shapes. FIG. 9 shows a ballistic protection packet 21 of rectangular shape. Other usable shapes include squares, ellipsoid, parallelogram, circles, and dog bone shapes of ballistic protection packets can be used. The previous figures depict the ballistic protection pads in various shapes. The ballistic protection pads can be provided in any shape to fit the pockets or the pockets can be formed to fit the shape of the pads.

The over garments pants and shorts can include holding pockets used for storage. The holding pockets can be configured to hold extra ammunition, tear gas, grenades, a flashlight, or another tactically important device. The holding pocket can be additionally protected by ballistic protection pads. The ballistic protection pads allow the ammunition, the tear gas, or the grenade to be safely carried without the added risk of ballistics damaging the pocket's contents.

The over garments pants and shorts can further comprise a hard plate that can be inserted into the pockets. The hard plate can be placed in front of a ballistic protection packet. Placing the hard plate in front of the ballistic protection packet or pad provides the advantage of dispersing the energy of the bullet or projectile. The bullet or projectile contacts the hard plate, wherein the hard plate shatters. The ballistic pads then ensure that the bullet or projectile does not injure the wearer.

The hard plate can be a metal plate or a ceramic tile. The hard plate can encapsulated in polyurethane for further protection.

The following tests were performed on the embodiment over garments:

FIRST TEST—A Smith and Wesson 38-caliber gun was used with a 38-caliber hollow point bullet. The bullet was fired at the over garment using a seventeen layers of ballistic material pads in the ballistic protection packets; the bullet bounced off the over garment.

SECOND TEST—Smith and Wesson 40-caliber semi-Automatic gun was used with a Smith and Wesson 40-caliber hollow point. The bullet was fired at seven yards from the test object and with seventeen layers of ballistic material pads in the ballistic protection packets; the bullet bounced off the over garment.

THIRD TEST—The over garment was taped to a bucket full of lead. At a distance of seven yards, a Smith and Wesson 686 gun with a 4" barrel was fired using a 357-magnum black talon hollow point bullet. The bullet embedded in the ballistic protection material without penetrating through the material.

FOURTH TEST—The over garment was tested with a Colt 1911 gun that fired a 45-caliber black talon hollow point bullet at seven yards. The bullet embedded in the fabric without penetrating through the fabric.

While these embodiments have been described with emphasis on the preferred embodiments, it should be understood that within the scope of the appended claims, the embodiments might be practiced other than as specifically described herein.

What is claimed is:

1. An over garment body armor comprising:

a. over garment shorts, wherein the over garment shorts comprises at least two leg pockets and at least one back pocket, wherein the at least two leg pockets cover a femoral artery path in each leg, and wherein the at least one back pocket covers a lower portion of a spine; and b. ballistic protection pads configured to fit within the pockets; wherein c. the over garment shorts are sized to be worn over outer clothing; and wherein d. a flap comprising a body armor plate is removable secured to a first hip on a side of the over garment shorts and to a second hip on an opposite side of the over garment shorts, wherein the flap including the body armor plate simultaneously covers the entire portion of a lower abdomen and a genital area.

2. The over garment body armor of claim 1, further comprising a hard armor plate configured to fit within the pockets.

3. The over garment body armor of claim 2, wherein the hard armor plate is composed of a metal plate or a ceramic tile.

4. The over garment body armor of claim 1, wherein the over garment shorts are made of cotton, nylon cotton blends, nylon, other microfiber materials, or combinations thereof.

5. The over garment body armor of claim 1, wherein the over garment shorts further comprise a hip pocket that covers the sides of the hips.

6. The over garment body armor of claim 1, wherein the over garment shorts further comprise a front pocket that covers the genital area.

7. The over garment body armor of claim 1, wherein the over garment shorts further comprise at least two back leg pockets that covers the femoral artery path on the back of each leg.

8. The over garment body armor of claim 1, wherein the ballistic protection pads are composed of para-aramid, polyethylene, or combinations thereof.

9. The over garment body armor of claim 1, wherein the pockets are secured closed by a member selected from the group consisting of hook and loop fasteners, zippers, snaps, and buttons, stitching and adhesive, and combinations.

10. An over garment body armor comprising:

a. over garment long pants, wherein the over garment shorts comprises at least two leg pockets and at least one back pocket, wherein the at least two leg pockets cover a femoral artery path in each leg, and wherein the at least one back pocket covers a lower portion of a spine; and b. ballistic protection pads configured to fit within the pockets; wherein c. the over garment pants are sized to be worn over outer clothing; and wherein d. a flap comprising a body armor plate is removable secured to a first hip on a side of the over garment long pants and to a second hip on an opposite side of the over garment long pants, wherein the flap including the body armor plate simultaneously covers the entire portion of a lower abdomen and a genital area.

11. The over garment body armor of claim 10, further comprising a hard armor plate configured to fit within the pockets.

12. The over garment body armor of claim 10, wherein the hard armor plate is composed of a metal plate or a ceramic tile.

13. The over garment body armor of claim 10, wherein the over garment pants are made of cotton, nylon cotton blends, nylon, other microfiber materials, and combinations thereof.

14. The over garment body armor of claim 10, wherein the over garment pants further comprise a hip pocket that covers the sides of the hips.

15. The over garment body armor of claim 10, wherein the over garment pants further comprise a front pocket that covers the genital area.

16. The over garment body armor of claim 10, wherein the over garment pants further comprise at least two back leg pockets that covers the femoral artery path on the back of each leg.

17. The over garment body armor of claim 10, wherein the ballistic protection pads are composed of para-aramid, polyethylene, or combinations thereof.

18. The over garment body armor of claim 1, wherein the pockets are secured closed by a member selected from the group consisting of hook and loop fasteners, zippers, snaps, and buttons, stitching and adhesive.

* * * * *